US005575270A

United States Patent [19]

Casas-Salva

[11] Patent Number: 5,575,270

[45] Date of Patent: Nov. 19, 1996

[54] AIR GUNS

[75] Inventor: Francisco Casas-Salva, Sant Boi de Llobregat, Spain

[73] Assignee: Industrias el Gamo, S.A., Barcelona, Spain

[21] Appl. No.: 344,140

[22] Filed: Nov. 23, 1994

[30] Foreign Application Priority Data

Sep. 21, 1993 [ES] Spain ..... 9402407 U
Nov. 24, 1993 [FR] France ..... 93 14267

[51] Int. Cl.[6] ..... F41B 11/14; F41B 11/18; F41B 11/22

[52] U.S. Cl. ..... 124/67

[58] Field of Search ..... 124/59, 65, 66, 124/67

[56] References Cited

U.S. PATENT DOCUMENTS

| | | | |
|---|---|---|---|
| 2,633,839 | 4/1953 | Lawrence | 124/67 |
| 3,302,319 | 2/1967 | Rosselet | 124/67 X |
| 3,472,218 | 10/1969 | La Mers | 124/67 |
| 4,367,723 | 1/1983 | Resuggan | 124/67 |
| 4,848,307 | 7/1989 | Tsao | 124/59 |
| 4,883,042 | 11/1989 | Wackrow | 124/67 |
| 5,205,271 | 4/1993 | Casas Salva | 124/66 |

FOREIGN PATENT DOCUMENTS

| | | | |
|---|---|---|---|
| 2526896 | 1/1976 | Germany | 124/67 |
| 566951 | 9/1957 | Italy | 124/67 |
| 459817 | 9/1968 | Switzerland | 124/67 |
| 3306 | 12/1908 | United Kingdom | 124/67 |
| 937658 | 9/1963 | United Kingdom . | |
| 2173287 | 10/1986 | United Kingdom . | |

*Primary Examiner*—John A. Ricci
*Attorney, Agent, or Firm*—Graybeal Jackson Haley LLP

[57] ABSTRACT

Improvements in hinged barrel air guns are disclosed where the air gun has a barrel 28 acting as a lever arm to compress a spring 4 attached to an axially movable piston 1 that is tightly inserted in a compression chamber 2 and has thrusting element 5 associated with the piston for compressing said spring and a safety catch 6 which locks the piston in a spring compressed position suitable for shooting. The improvements consist of producing the piston 1 in a tubular shape molded in plastic material, including a contoured end wall 8 and 11, a plate 9 resistant to wear providing a link between the piston, the thrusting element 5 and the safety catch 6, and a dense inertial element 10 integral with the tubular piston. A casing 27 completely covers the barrel body 28 except for its front and rear ends. Each of the two lateral sides of the rear end 29 of the casing 27 have recesses 31 to fit, in the closed position of the gun, with corresponding projecting ridges 32 on the inner wall of each one of the limbs of a fork 30*a* in a one-piece body that extends rearwardly to form the compression chamber.

24 Claims, 3 Drawing Sheets

AIR GUNS

TECHNICAL FIELD

The invention relates to improvements in hinged barrel air guns where the barrel acts as a lever arm to compress the spring of a compression chamber mounted on the buttstock body of the gun to axially move a piston located inside the compression chamber. The piston is in contact with a loading spring and includes a material different from that of the remainder of the piston to ensure a tight fit between its external surface and the internal wall of the compression chamber. The piston is also associated with thrusting means in order to compress the spring and with a safety catch which locks the piston in a spring compressed position suitable for shooting.

BACKGROUND OF THE INVENTION

An example of the state of the art air gun is disclosed in U.S. Pat. No. 5,205,271 issued to the present inventor. The invention consists of a fork-shaped piece that is hinged on the barrel and that is secured to the compression chamber. A plastic casing is molded on the barrel, with a back part thereof pivotally hinged with a fork member that is also molded plastic. A rearward extension is integral with the front part of the compression chamber, and there is an axial passage extending through the rearward extension for the passage of the compressed air.

Additionally, prior art metallic pistons comprise a lengthwise slot serving for the connection of the thrusting means, designed to compress the piston spring, and for the inclusion of the safety catch associated to the trigger, which locks the piston at a spring compressed position. The slot sustains significant friction and impacts so it is characterized by its great resistance to wear.

To cut the piston cost, attempts have been made in producing a piston in plastic material incorporating a recess for the thrusting means and the safety catch. But even the harder plastic materials (regardless of their high cost that is incompatible with the aim sought) did not resist the stresses due to the repeated action of the thrusting element and the safety catch.

SUMMARY OF THE INVENTION

With the aim to cut the cost of the assembly "piston-sealing gasket-recess" while preserving the function and accurateness characteristics of the parts involved, the invention includes a piston:

- produced in plastic material, molded with the shape of a tubular body, closed at one end by a front wall, which includes a contoured end wall between the body of said piston and the compression chamber;
- a supplementary plate adjacent the piston having high resistance to wear and providing a connection between the plastic piston body and the thrusting means and the safety catch;
- a high density inertial element secured inside the tubular piston and adapted to provide the piston with an overall weight sufficient to produce the functional working inertia for the kind of gun used.

Also the one-piece body constituting the fork for the hinged connection with the barrel is made of molded plastic and extends rearward in a tubular shape to form the compression chamber itself. From the tubular portion an appendage in the shape of a planar member extends laterally and secures the firing mechanism, and more specifically, the piston-spring assembly loading, locking and releasing means.

The fork has a flat bottom, and on the inner faces of its two limbs there are directly opposed projecting ridges which provide an elongated double seat on which projecting ridges will snugly fit in the closed position of the gun. The seat-stop means have been adequately sized (with a sufficient length) to efficiently distribute and/or absorb the impact forces, so that they constitute an efficient alternative to the half-round stop described in the above-mentioned U.S. Pat. No. 5,205,271, and a notable improvement in respect to the conventional stepped positioning stops.

The above and other objects, advantages and features of the present invention will become more apparent from the following description of the drawings and of a preferred embodiment thereof.

BRIEF DESCRIPTION OF THE DRAWINGS

The invention will now be described in detail with reference to the accompanying drawings wherein.

DETAILED DESCRIPTION OF THE PREFERRED EMBODIMENTS

Figure 1:
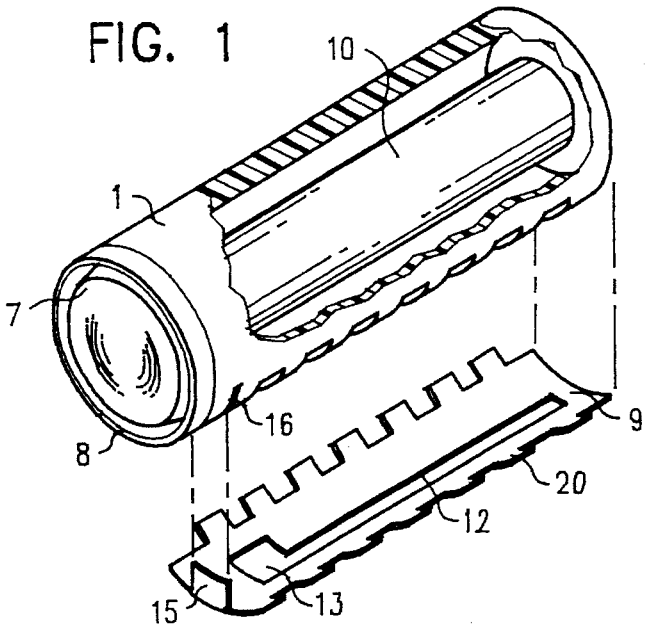
FIG. 1 is a perspective view, partially exposed, of the piston associated to its supplementary elements (plate and rod)
Figure 3:
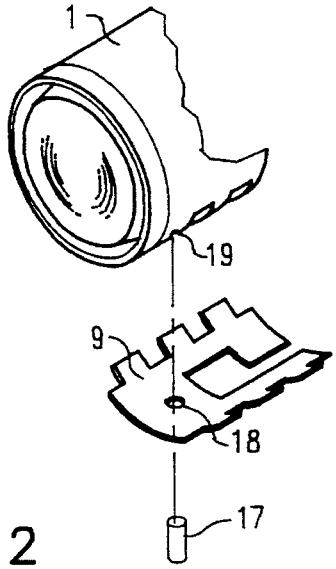
FIG. 3 is a partial perspective view of the piston associated to the plate provided with a different locking means.
Figure 2:
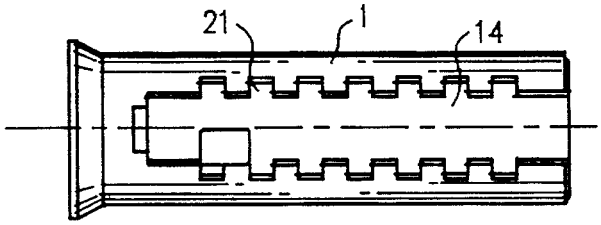
FIG. 2 is an external plan view of the piston which evidences a housing for the plate.
Figure 4:
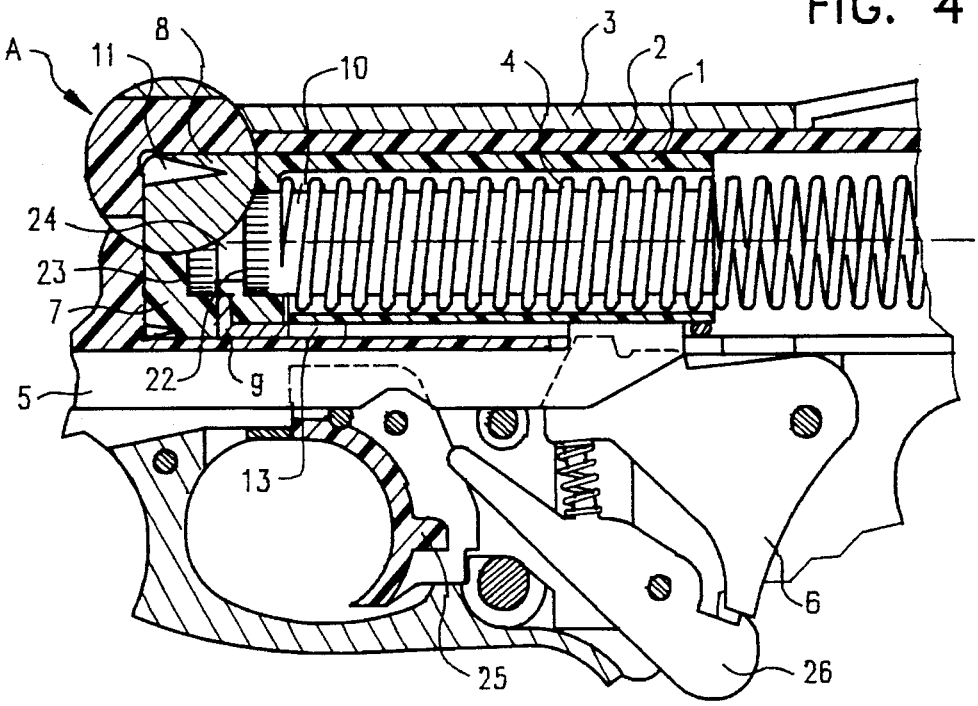
FIG. 4 is a partially exposed view showing the piston, the compression chamber, a part of the gun body with an enlarged area (A) of the piston end evidencing the contoured end wall of the piston.

The gun illustrated in FIGS. 1 through 9, such as a rifle, comprises a tubular, axially movable piston 1, located inside a compression chamber 2 linked to the gun body 3. The piston is in contact with a loading spring 4 and has a wall 8 adapted to tightly secure the piston 1 and the internal wall of the chamber 2. Piston 1 is associated with thrusting element 5, a hinged push-rod, which can compress spring 4, as well as a safety catch 6 which locks the spring 4 in a compressed position suitable for shooting.

The piston 1 is preferably made of plastic material, molded in a tubular configuration and closed at one end to form end 7 which includes wall 8 shaped by the same molding operation. The link between the piston 1 and the thrusting element 5 and the safety catch 6 is achieved through a plate 9 having a great resistance to wear. The interior of piston 1 houses a dense inertial element 10, adapted to provide the piston with an overall weight according to the functional working inertia needed.

Wall 8 on the piston front end 7 has a lip that includes a flared peripheral portion 8 and an annular recess 11 circumscribed by the flared portion 8.

The plate 9 includes a lengthwise slot 12 in which the thrusting element 5 is movable. The slot 12 terminates, at one end, in a lateral extension 13 adapted to house the safety catch 6. The plate 9 is backed on the bottom of the housing 14 adjacent the piston 1 lateral surface and whose depth is equal to the plate 9 width so that the external surface of plate 9 is at same level as the piston 1 external surface; said plate comprising means for locking it to the housing 14.

The plate 9 is secured to the housing 14 (see FIG. 1) through a bent lug 15 which is housed within a slit 16 of the piston 1. Locking can also be achieved with a stud 17 passing through a hole 18 made in the plate 9, and which is inserted within a hole 19 in piston 1 (see FIG. 3).

The plate 9 has, on its periphery, a plurality of protrusions and depressions 20, adapted to be attached to a plurality of complementary protrusions and depressions 21 on the housing 14.

The dense inertial element is preferably a rod 10 axially oriented in and integral with the tubular piston 1. The rod 10 is made integral with the tubular piston 1 during the molding operation at end 22 of rod 10 which has peripheral striations 23 and a notch 24. The plate 9 and the dense inertial element or rod 10 can be made as an integral element.

The gun includes a trigger 25 which operates the safety catch 6 by means of a safety counter-catch 26.

According to FIGS. 5 through 10, the hinged barrel air gun of the present invention has a barrel that acts as a lever arm to compress the spring of a compression chamber mounted on the buttstock body of the gun, and includes a plastic casing 27 molded on barrel 28 and a rear part 29 hinged around a pin 34. A plastic one-piece body 30 has a fork **30*a* with the projecting ridges 32 on the inner walls of its limbs. Fork 30*a* extends rearwardly, thereby forming a cylindrical cavity (or compression chamber) 30*c* which is intended to house a piston such as the plastic tubular piston previously described. From cavity 30*c* a planar-shaped lateral extension 30*d* extends outwardly for the support of the firing mechanism of the gun. An axial passage 30*b* in alignment with the axial tubular passage 28*a* of the barrel 28 in the closed position of the gun allows cavity 30*c* to communicate with the bottom 47 of the fork 30*a***. The aforesaid structure is described in U.S. Pat. No. 5,205,271, incorporated herein by reference.

In the present invention the rear end of barrel 28 is coplanar, with the rear face of the rear part 29 surrounding it completely. In contrast, in U.S. Pat. No. 5,205,271 the projecting rear portion of the barrel acts as a closing stop with regard to a reciprocal half-round stop in the fork. The rear part 29 has in its lateral sides and adjacent to its lower side recesses 31 substantially elongated in the direction of the barrel and snugly fitting, when the gun is in the closed position, with projecting ridges 32 on the inner walls of the limbs of fork **30*a*. This configuration ensures alignment of tubular passage 28*a* with passage 30*b*, passage 30*b* ending in flat bottom 47 of fork 30*a***.

Projecting ridges 32 provide a double seat at both sides of rear part 29 of the casing or barrel body 27, and because of their considerable length they provide an adequate stop and positioning means (furnishing a substantial distribution and absorption of impact forces) which guarantees an exact alignment, in firing position of the gun, of passages **28*a* and 30*b***.

Projecting ridges 32 each include a plane **32*a* oriented at right angles to the inner wall of fork 30*a* and oriented parallel to the longitudinal axis of axial passage 30*b* in a preferred embodiment. Projecting ridges 32 also include two planes 32*a* and 32*b* which are at right angles to the inner wall of fork 30*a*, intersect each other at an angle of slightly less than 90°, and have their frontal intersecting angle edge 32*c* rounded Recesses 31 have two planes 31*a* and 31*b* which are at right angles to the major face of the recess 31 and intersect each other at an angle 31*c* of slightly more than 90°, with planes 31*a* being, in a preferred embodiment, oriented parallel to the axis of barrel 28**.

Figure 8:
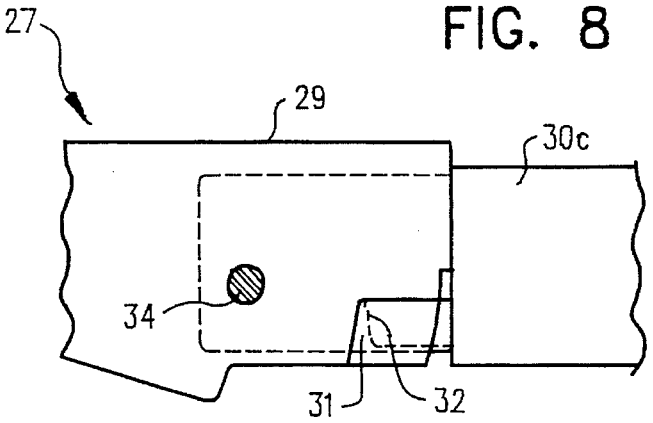
FIG. 8 is a schematic view showing the relative arrangement of the parts constituting the gun in firing position.
Figure 9:
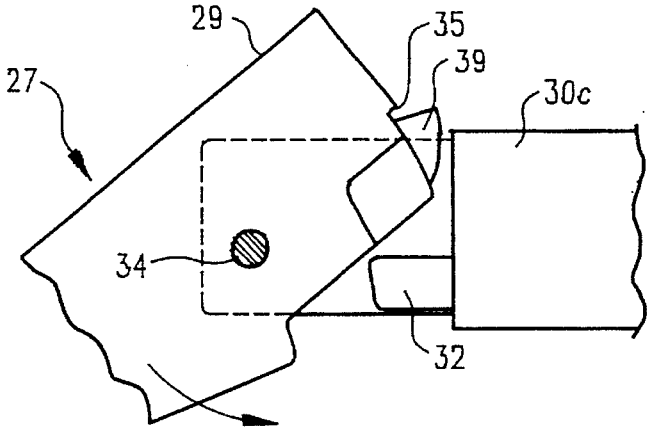
FIG. 9 is a schematic view showing the relative arrangement of the parts constituting the gun in the open position.
Figure 10:
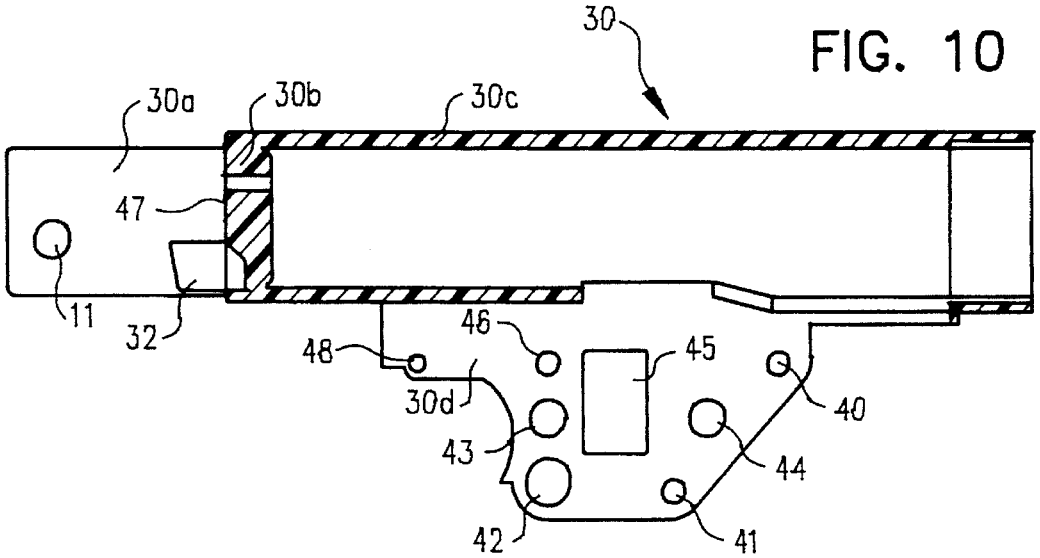
FIG. 10 is a longitudinally sectional view showing a one-piece body made according to the invention and integrating the barrel coupling fork, the compression chamber and a support for the firing mechanism of the gun.

FIGS. 8 and 9 show how the forward angle **39*c* and rearward angle 31*c* of projecting ridges 39 and recesses 31 allow the closing and opening of the gun without contact between these parts. It can also be seen in these figures that there is a cutoff 35 at the back of rear part 29 which serves to facilitate the tilting of the barrel body without appreciable friction against flat bottom 47 of fork 30*a***.

Figure 5:
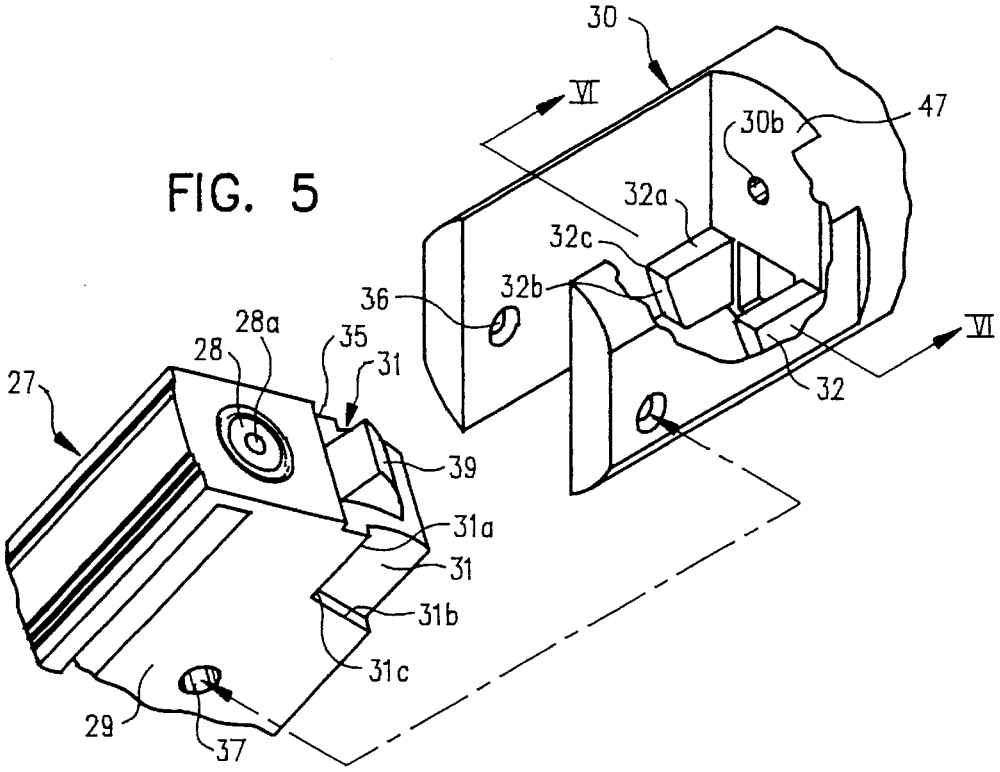
FIG. 5 is a partial perspective view of the two parts constituting the gun in question, i.e. the barrel body and the fork, in an uncoupled state.
Figure 6:
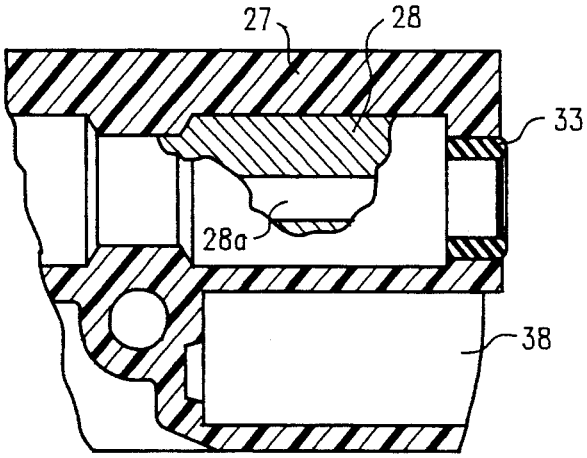
FIG. 6 shows a cross-sectional detail of the same gun with its parts coupled, taken along section line VI—VI of FIG. 1.
Figure 7:
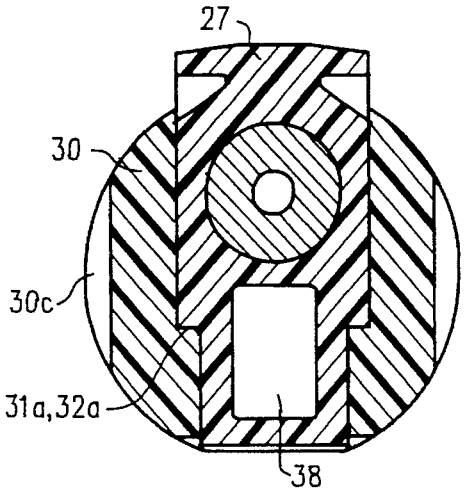
FIG. 7 is an enlarged scale view in partial longitudinal section of the rear part of the barrel body.

As can be seen in FIGS. 5 and 6, in order to provide a tight seal in the closed position of the gun between the inlet of tubular passage **28*a* at the back end of the barrel 28 and passage 30*b*, rear part 29 of the barrel is surrounded by a ring-shaped groove in which a sealing ring 33 nests and projects slightly from the back face of rear part 29 of casing 27**.

Other elements appearing in the figures and not having been described are the following:

- holes 36, directly opposed in the limbs of fork **30*a*, for hinged connection with the rear part 29 of the barrel body by means of pin 34 mounted through hole 11 of rear part 29**;
- recess 38 housing a closure catch 39 with the hinged plastic casing 27, rear part 29 and plastic body 30 in the firing position of the gun;
- hole 39 for the pin-jointing of the trigger, hole 40 for the pin-jointing of a pawl associated to the piston (not shown) of the compression chamber, hole 41 for the fitting of a counter-pawl, and hole 42 for the fitting of a trigger safety catch;
- holes 43 and 44 for the fitting of centering elements, opening 45 for the passage of a lever spring, and hole 46 for the fitting of a pin associated to a lever connecting rod.

While particular embodiments of the present invention have been described in some detail herein above, changes and modifications may be made in the illustrated embodiments without departing from the spirit of the invention.

I claim:

1. In an air gun of the type having a hinged barrel with the barrel acting as a hinged lever arm to compress a spring attached to an axially movable piston that is tightly inserted in a compression chamber mounted on the buttstock body of the gun, and further including a hinged push-rod thrusting means associated with the piston for compressing the spring, as well as a safety catch which locks the piston in a spring compressed position for shooting, an improvement comprising;

a tubular piston comprised of a synthetic polymer and having a wall adjacent an end of the compression chamber that is contoured to tightly fit the compression chamber;

a wear resistant element between said piston, the thrusting means and the safety catch;

inertial means inside said tubular piston to provide said piston with sufficient weight for functional working inertia.

2. The improvement as claimed in claim 1 wherein said piston wall includes a flared lip and an annular recess adjacent to said flared lip.

3. The improvement as claimed in claim 1 wherein said wear resistant element consists of a plate having a lengthwise slot in which the thrusting means is movable, said lengthwise slot terminating at one end in a lateral extension adapted to house the safety catch, said plate including means for locking it to the housing.

4. The improvement as claimed in claim 3 wherein said means for locking said plate to the housing is a bent cross pin housed within a slit of an external wall of said piston.

5. The improvement as claimed in claim 3 wherein said means for locking said plate to the housing is a stud passing through a hole in said plate and which is inserted within a hole in an external wall of said piston.

6. The improvement as claimed in claim 3 wherein said plate comprises, on its periphery, a plurality of protrusions and depressions matable with complementary protrusions and depressions on the housing.

7. The improvement as claimed in claim 1 wherein said inertial means is a rod located within said piston.

8. The improvement as claimed in claim 7 wherein said rod is integral with said piston body and has an end with peripheral striations and an axial notch thereon.

9. The improvement as claimed in claim 1 wherein said plate provides a link between said piston, the thrusting means and the safety catch, and said inertial means are integral.

10. In an air gun of the type having a hinged barrel with the barrel acting as a hinged lever arm to compress a spring attached to an axially movable piston that is tightly inserted in a compression chamber mounted on the buttstock body of the gun, and further including a hinged push-rod thrusting means associated with the piston for compressing the spring, as well as a safety catch which locks the piston in a spring compressed position for shooting, an improvement comprising;

a tubular piston comprised of a synthetic polymer;

a wear resistant element between said piston, the thrusting means and the safety catch; and inertial means inside said tubular piston to provide said piston with sufficient weight for functional working inertia.

11. The improvement as claimed in claim 10 wherein said wear resistant element is a plate having a lengthwise slot in which the thrusting means is movable, said lengthwise slot terminating at one end in a lateral extension adapted to house the safety catch, said plate including means for locking it to the housing.

12. The improvement as claimed in claim 11 wherein said plate comprises, on its periphery, a plurality of protrusions and depressions mutable with complementary protrusions and depressions on the housing.

13. The improvement as claimed in claim 10 wherein said inertial means is a rod located within said piston.

14. The improvement as claimed in claim 13 wherein said rod is integral with said piston body and has an end with peripheral striations and an axial notch thereon.

15. The improvement as claimed in claim 10 wherein said plate provides a link between said piston, the thrusting means and the safety catch, and said inertial means are integral.

16. In an air gun of the type having a hinged barrel with the barrel acting as a hinged lever arm to compress a spring attached to an axially movable piston that is tightly inserted in a compression chamber mounted on the buttstock body of the gun, and further including a hinged push-rod thrusting means associated with the piston for compressing the spring, as well as a safety catch which locks the piston in a spring compressed position for shooting, an improvement comprising;

a tubular piston;

a wear resistant element between said piston, the thrusting means and the safety catch; and inertial means inside said tubular piston to provide said piston with sufficient weight for functional working inertia.

17. The improvement as claimed in claim 16 wherein said wear resistant element is a plate having a lengthwise slot in which the thrusting means is movable, said lengthwise slot terminating at one end in a lateral extension adapted to house the safety catch, said plate including means for locking it to the housing.

18. The improvement as claimed in claim 17 wherein said plate comprises, on its periphery, a plurality of protrusions and depressions matable with complementary protrusions and depressions on the housing.

19. The improvement as claimed in claim 18 wherein said inertial means is a rod located within said piston.

20. The improvement as claimed in claim 19 wherein said rod is integral with said piston body and has an end with peripheral striations and an axial notch thereon.

21. The improvement as claimed in claim 16 wherein said plate provides a link between said piston, the thrusting means and the safety catch, and said inertial means are integral.

22. In an air gun of the type having a hinged barrel with the barrel acting as a hinged lever arm to compress a spring attached to an axially movable piston that is tightly inserted in a compression chamber mounted on the buttstock body of the gun, and further including a hinged push-rod thrusting means associated with the piston for compressing the spring, as well as a safety catch which locks the piston in a spring compressed position for shooting, an improvement comprising;

a piston; and a wear resistant element between said piston, the thrusting means and the safety catch.

23. The improvement as claimed in claim 22 wherein said wear resistant element is a plate having a lengthwise slot in which the thrusting means is movable, said lengthwise slot terminating at one end in a lateral extension adapted to house the safety catch, said plate including means for locking it to the housing.

24. The improvement as claimed in claim 23 wherein said plate comprises, on its periphery, a plurality of protrusions and depressions matable with complementary protrusions and depressions on the housing.

* * * * *